US010465980B2

(12) United States Patent
Jayaram

(10) Patent No.: US 10,465,980 B2
(45) Date of Patent: Nov. 5, 2019

(54) SELF-COOLING DEVICE FOR BEVERAGES

(71) Applicant: Synergystic Pte. Ltd., Singapore (SG)

(72) Inventor: Prem Anand Jayaram, Singapore (SG)

(73) Assignee: SYNERGYSTIC PTE. LTD., Singapore (SG)

( * ) Notice: Subject to any disclaimer, the term of this patent is extended or adjusted under 35 U.S.C. 154(b) by 86 days.

(21) Appl. No.: 15/281,055

(22) Filed: Sep. 29, 2016

(65) Prior Publication Data

US 2017/0089630 A1 Mar. 30, 2017

(30) Foreign Application Priority Data

Sep. 30, 2015 (SG) ..... 10201508126S

(51) Int. Cl.
*F25D 31/00* (2006.01)

(52) U.S. Cl.
CPC ..... *F25D 31/007* (2013.01)

(58) Field of Classification Search
CPC ..... F25D 31/007; F25D 2700/16; F25B 1/04; F25B 27/00
See application file for complete search history.

(56) References Cited

U.S. PATENT DOCUMENTS 5,421,159 A * 6/1995 Stokes ..... B67D 3/0009 62/3.64
6,073,454 A * 6/2000 Spauschus ..... C09K 5/041 62/101
6,269,653 B1 * 8/2001 Katusa ..... F25D 11/00 62/238.2
8,555,656 B2 * 10/2013 Al-Qaffas ..... F25B 21/04 220/592.17
2009/0211202 A1 * 8/2009 Lemme ..... F25D 17/042 53/432
2009/0230032 A1 * 9/2009 Flick ..... A23L 2/50 210/85

FOREIGN PATENT DOCUMENTS

CN 103654158 A * 3/2014
CN 203987740 U * 10/2014
JP 2001069148 A * 3/2004

OTHER PUBLICATIONS

Shirai, Cooler for Wine, Mar. 4, 2004, JP2004069148A, Whole Document.*
Wang et al., USB Refrigerating Cup, Mar. 26, 2014, CN103654158A, Whole Document.*
Yang et al., Smart Multipurpose Tea Water Pot, 1210/2014, CN203987740U, Whole Document (Year: 2014).*

* cited by examiner

*Primary Examiner* — Larry L Furdge
(74) *Attorney, Agent, or Firm* — WPAT, PC

(57) ABSTRACT

A self-cooling device to cool a beverage, the device comprising a miniaturised scroll compressor, a heat sink, an electric motor, an expansion valve allowing passage of a refrigerant into the network of capillaries before entering back into the reservoir, a power source of electrical energy, several temperature gauging devices, a micro-processor, a simple user interface for temperature setting, and an on/off switch.

The miniaturised scroll compressor pumps the refrigerant through itself and then through a heat sink (the second heat exchange) and then through an expansion valve through the network of capillaries running inside the walls of the container, whereby a first heat exchange takes place. The refrigerant then returns to the reservoir.

15 Claims, 3 Drawing Sheets

SELF-COOLING DEVICE FOR BEVERAGES

FIELD OF THE INVENTION

The present invention relates to the field of self-cooling device for beverage containers. More particularly, it relates to a self-cooling electrical-powered device which cools a container of beverage, using either an internal or external electrical power source, to cool the beverage in the said beverage container. Self-cooling or self-chilling beverage containers would allow users obtain a cooled beverage, without the requirements of an additional component, such as ice, in the outdoors.

BACKGROUND AND DESCRIPTION OF THE PRIOR ART

There have been many inventions and patents for self-cooling beverage containers. The direction taken by inventors in the past can be in any one of these approaches:

(A) Inventions proposing endothermic or exothermic chemical reactions to produce a chilling or cooling effect in the beverage.

(B) Inventions proposing use of refrigeration effect by compression and expansion of a liquefied gas causing heat to be absorbed, producing a refrigerating effect in the beverage.

(C) Inventions proposing use of desiccant absorbing agents and water to produce a cooling effect on the beverage.

(D) Inventions proposing use of portable power source to cool the beverage.

(E) Inventions proposing use of natural evaporative/cooling process (without power/chemical means) to cool the beverage.

The first group of devices generally requires two or more chemicals to be combined quickly to produce an endothermic or exothermic reaction. An example of an endothermic type chiller is the ICE PACK. The ice pack is a product that uses ammonium nitrate and water to absorb heat rapidly for emergency cooling in medical applications. Several devices depend on similar endothermic reactions to produce a chilling effect that can be put to effective use for commercialization.

The second group of devices generally relate to chilling devices. The household refrigerator belongs to this group of devices. The refrigeration effect occurs when a compressed and liquefied gas is expanded through a small aperture. The evaporation of the liquefied gas to a gaseous state causes considerable heat to be absorbed through the walls of the expansion tube, thereby producing a refrigeration effect.

The third group of devices use desiccant absorbing agents and water. Typically, a water gel is smeared on the inside walls of a first sealed and evacuated chamber. A second sealed chamber contains a desiccant that absorbs the water vapour. By opening a small passage way between the first chamber and the second chamber, rapid vaporization of the water in the first chamber occurs, resulting in cooling. The absorbing desiccant usually heats up to a high temperature due to the heat of condensation of water vapour removed from the first chamber. Both a heating and cooling effect may be obtained by this method.

The fourth group of devices relies on well-known electrical effects for both heating and cooling.

Devices of the first group (chemical endothermic and exothermic reactions) generally rely on toxic and environmentally unfriendly chemicals. They have not been successfully used in the commercial applications for either the food or the beverage industries. Existing devices of the second group require very bulky pneumatic circuits, and cannot economically be used in small containers such as beverage cans or food cans. Devices of the third group have been applied in some food and beverage applications but only under expensive research programs. Even so such devices still do not appear to hold any promise of commercialization due to the expensive designs involved and the toxic nature of the chemical desiccants involved.

Containers for beverages are known in which the components of this chemical reaction are arranged separately in respective compartments of a chamber formed between a first receptacle, containing the beverage, and a second outer receptacle into which the first receptacle is inserted. The components mentioned above generally consist of a liquid and a salt, present in granular form, and the reaction between them is initiated by tearing a diaphragm separating the two compartments, for example by means of a breaking device integral with an inward-flexible base of a second receptacle.

There are some self-cooling devices using Peltier effect to cool beverages. Such uses for devices using the Peltier effect include small applications as small as a beverage cooler which is powered by a laptop using the USB wire. However such devices are not effective in cooling beverages due to their extremely low efficiency in using electrical energy to create a thermodynamic effect.

The approaches taken seem to be a self-cooling or self-chilling beverage container. Even though there are many inventions for such a product, these suffer from a number of disadvantages:

- high unit production cost leading to a high retail price for a one-time use
- ecological damage caused by the self-cooling unit in the beverage container
- problems in re-cycling the beverage container due to existence of self-cooling unit
- use of chemicals to produce a cooling reaction causing possible
- contamination of the beverage U.S. Pat. No. 6,266,974 B1 (W. C. Linden Inc.) proposed a refrigerated beverage mug which includes a self-contained mechanical refrigeration unit which is powered by a power unit mounted onboard the beverage mug. The mechanical refrigeration unit is a closed loop system which is mounted to the beverage mug and includes a compressor, a condenser, an expansion flow passage and an evaporator. The condenser and the evaporator are integrally formed with the main body of the beverage mug while the compressor is mounted to the beverage mug for circulation of a refrigerant through the condenser, the expansion flow passage and the evaporator. The power unit includes a chamber which contains a pressurized, expansible fluid such as liquid nitrogen, which is selectively released for passing through a pressure chamber of the compressor to power the compressor and the mechanical refrigeration unit. A manifold is integrally formed into the compressor housing for passing the expansible fluid from the compressor and across a portion of the condenser.

U.S. Pat. No. 7,178,343 B2 (Innovative Displayworks Inc.) discloses a wine cooler. It uses a thermoelectric cooling system includes a thermoelectric cooling system comprising at least one thermoelectric couple, each thermoelectric couple having a cold and hot junction. This invention uses a thermoelectric chip and a heat sink. The means of supplying power to the at least one thermoelectric couple is a 12 V DC source.

The inventor has observed that while there is great interest in such an invention, there does not seem to be any viable product meeting the requirements for a self-cooling or self-chilling beverage container. The inventor has taken a different approach to propose a self-cooling or self-chilling device for beverage containers. Such an invention would not only meet the requirement for a beverage to be self-cooling or self-chilling, but also meet these criteria as well:

- practical,
- cost effective,
- simplistic design,
- easy to use,
- safe for use, and
- does not contaminate the beverage contents or the environment What is needed, therefore, is a new approach for a self-cooling unit for a beverage container that is portable, and provides a self-contained miniaturised cooling means using electrical power without the need to freeze or chill the container or beverage first. It is also desirable to have such a container efficiently cool a beverage within the beverage container without the need to cool the surroundings of the beverage container in the process. It is further desirable that such a self-cooling unit be re-usable to offset the costs of such a self-cooling unit.

What is more desirable is if the self-cooling or self-chilling electrical-powered unit can be portable and re-usable so that with sufficient electrical power sources, it has the capability to cool more than 1 beverage payload.

One consideration is to create an empty mug or container or receptacle with such an electric powered self-cooling or self-chilling device. Beverages can then be used to fill up the empty container or receptacle or mug.

Creating and manufacturing empty containers or mugs with an electric-powered self-cooling device while costly, would, through re-use, be considered less costly than a "one-time usage" beverage container or beverage receptacle.

SUMMARY OF INVENTION

A first objective of the invention is a self-cooling electric powered device to cool a container of beverage, the device comprising:

- a miniaturised scroll compressor;
- an electric motor, having an inlet for electric power;
- a network of capillaries, containing a refrigerant, said network of capillaries commencing from a reservoir, to the miniaturised scroll compressor, to a heat sink, and through an expansion valve;
- a power source of electrical energy;
- a plurality of temperature gauging devices;
- a micro-processor;
- a simple user interface for temperature setting; and
- an on/off switch wherein upon turning on the on/off switch, the power source provides electrical energy to start the electric motor to drive a miniaturised scroll compressor, pumping the refrigerant from the reservoir through itself, then through a heat sink and then through the expansion valve, thereby cooling the refrigerant before the refrigerant passes through the network of capillaries. For clarity, the scroll compressor acts as both a device to compress a unit volume of refrigerant into a smaller volumetric space, and as a pump to force the refrigerant through the capillary network.

A first heat exchange takes place when the refrigerant absorbs heat energy from the beverage, through the network of capillaries located on the inner wall of the beverage container.

A second heat exchange takes place when the refrigerant passes from the compressor into the heat sink before the refrigerant is forced through the expansion valve, and the heat exchanges continues until the beverage is cooled.

A first heat exchange takes place as the cooled refrigerant passes through the network of capillaries located on the inner wall of the beverage container, whereby heat energy is absorbed from the beverage (at a slightly higher temperature) contained in therein. A second heat exchange takes place when the refrigerant passes from the compressor into a heat sink before it reaches the expansion valve. In the second heat exchange, the heat energy of the, now warmer (due to the compression done on it by the compressor), refrigerant is transferred to the heat sink. The refrigerant, then, is again pumped by the scroll compressor through the expansion valve into the network of capillaries. By going through the heat sink, the refrigerant is cooled down before it is pumped through the expansion valve before reaching the network of capillaries again. Thus when it goes through the expansion valve, it is more efficient in further reducing the temperature of the beverage In essence, the refrigerant flows through the reservoir to the compressor, the heat sink, the expansion valve, the capillary network, and back into the reservoir. When the refrigerant is in the compressor, it increases in temperature due to the additional pressure, and has to be cooled to the ambient temperature via the heat sink. When the high pressure/ambient temperature refrigerant is forced through the expansion valve, the pressure is drastically lowered, dropping the temperature. This cooled refrigerant then flows through the capillary network, absorbing heat from the liquid, raising its temperature back to ambient levels. Sufficient ambient temperature refrigerant is collected in the reservoir and then fed back into the compressor for a repeat cycle.

Preferably, the self-cooling device has a plurality of temperature gauging devices to detect the temperature of the beverage.

Preferably the self-cooling device has a network of capillaries embedded within the wall of the beverage container.

Alternatively, the network of capillaries is embedded within a sleeve used to enclose a container of beverage.

Alternatively, the self-cooling device may also have a network of capillaries embedded within the wall of a bucket-shaped container to contain a container of beverage.

Alternatively, the self-cooling device has a network of capillaries embedded within the walls, and frame of a mug-shaped container to hold a container of beverage.

Preferably, the temperature gauging device has the ability to detect that the contents are at a higher temperature that is desired by the user and would send its temperature readings to a micro-processor controlling the motor, which would then continue to pump refrigerant through the capillary network until the contents of the container come to the desired lower temperature. The description of how the temperature gauging devices would work is described later in this document.

Preferably the self-cooling device has an electrical power source consisting of batteries.

Preferably the self-cooling device has a power inlet from which to take electrical energy.

DESCRIPTION OF THE DRAWINGS

For a better understanding of the invention, its advantages, and the objects attained by its use, reference should now be made to the accompanying drawings. The accompanying drawings illustrate some embodiments of the invention and together with the description herein, serve to explain the workings and principles of the invention. The features of the inventive device as shown in these drawings are illustrative of their functions but their positions within the device are not fixed. The features of the inventive device show their relationship but their size and dimensions are not indicative of the actual parts in the inventive device.

DESCRIPTION OF PREFERRED EMBODIMENTS

Figure 1:
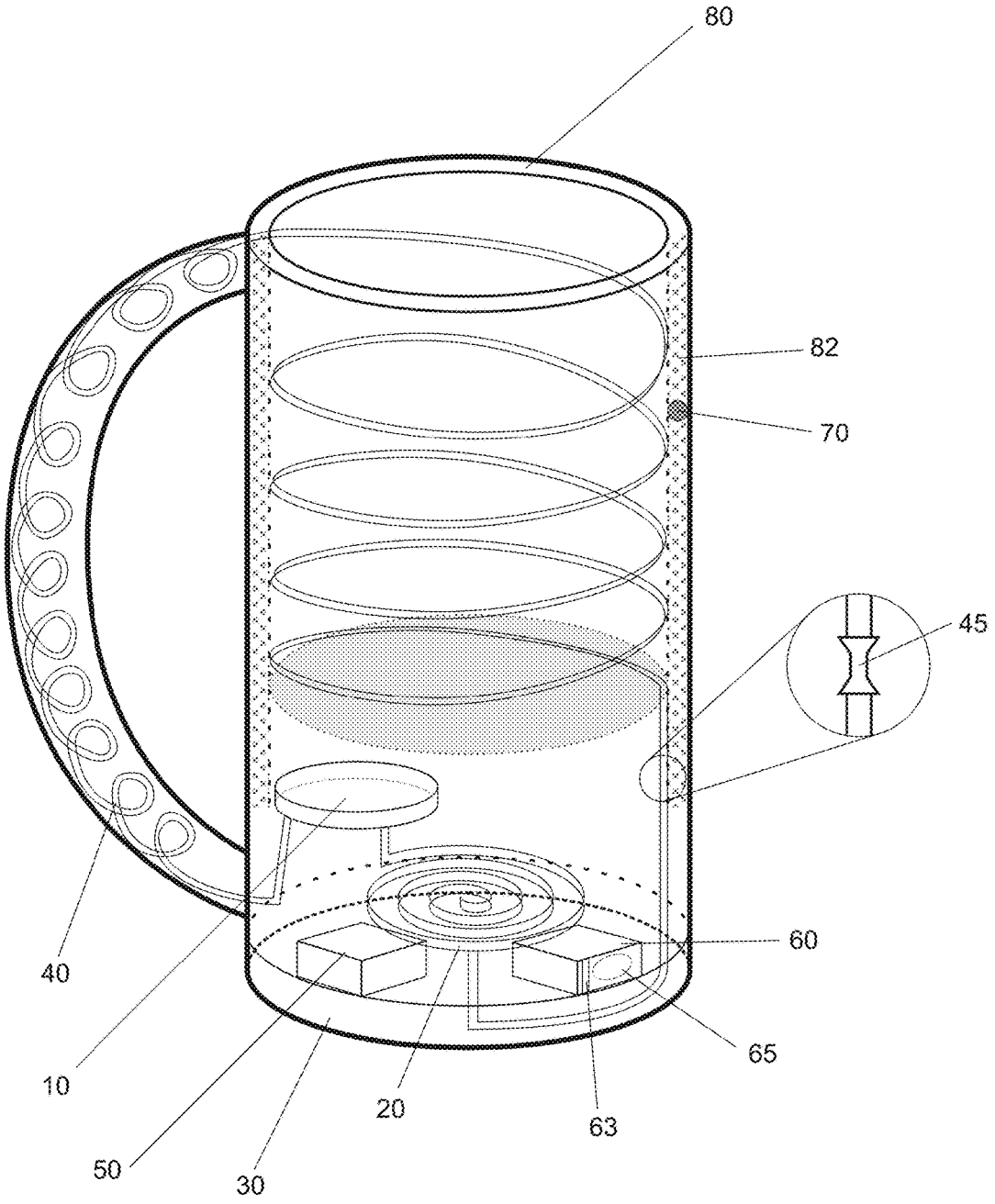
FIG. 1: is a first embodiment of a self-cooling device is in the form of a mug or similar sized container to hold beverage poured into it.

The inventive device is a self-cooling device which is used to cool a container of beverage. The device comprises:

- a miniaturised scroll compressor (20),
- an electric motor (50), with an inlet for electrical power (63),
- a network of capillaries (40), containing a refrigerant, said network of capillaries commencing from a reservoir (10) to the miniaturised scroll compressor, to a heat sink (30) and through an expansion valve (45),
- a power source of electrical energy (60),
- a plurality of temperature gauging devices (70),
- a micro-processor,
- an on/off switch (65), and
- a simple user interface for temperature setting The device can be turned on using the on/off switch (65) so that electrical energy from the power source (60) would start the electric motor (50) connected to a miniaturised scroll compressor (20).

Upon starting the motor, the refrigerant is pumped from reservoir (10) by the scroll compressor (20) through itself and then through a heat sink (30), then through an expansion valve (45) and into a network of capillaries (40). As the refrigerant is forced through the expansion valve (45), the refrigerant expands, and in expanding, the refrigerant is cooled, generating a chilling effect as it passes through the network of capillaries (40).

The cooled refrigerant absorbs heat energy indirectly from the beverage held inside the container as it passes through the capillary network within the interior cylindrical wall of the beverage container. A heat exchange process thus takes place as the cooled refrigerant passes through the network of capillaries, the cooled refrigerant absorbing heat energy indirectly from the beverage kept in the container via the interior wall of the container.

After passing through the network of capillaries, the now slightly warmed refrigerant returns to the reservoir.

Upon return to the reservoir, the refrigerant is once again, pumped and compressed through the compressor. The refrigerant flows through the heat sink, and is once again forced through the expansion valve, and upon expansion, generates a chilling effect.

Heat absorbed by the heat sink is passed into the atmosphere or ambient surroundings.

The cooled refrigerant again passes through the network of capillary tubes, absorbing heat indirectly from the beverage (now slightly cooled) held inside the container as the refrigerant passes through the capillary network within the interior cylindrical wall of the beverage container.

This heat exchange process continues until the temperature setting required by the user, using the user interface, has been attained. The heat exchange process is managed by a plurality of temperature gauging devices (70) in the interior wall (82) of the container. These temperature gauging devices (70) would send temperature readings of the contents of the beverage container to the micro-processor (not shown) controlling the motor (50). The motor (50) will operate the compressor (20) until the contents of the container, as detected by the temperature gauging devices (70), match the temperature desired by the user, set by a simple user interface for temperature setting, which is not shown.

Figure 2:
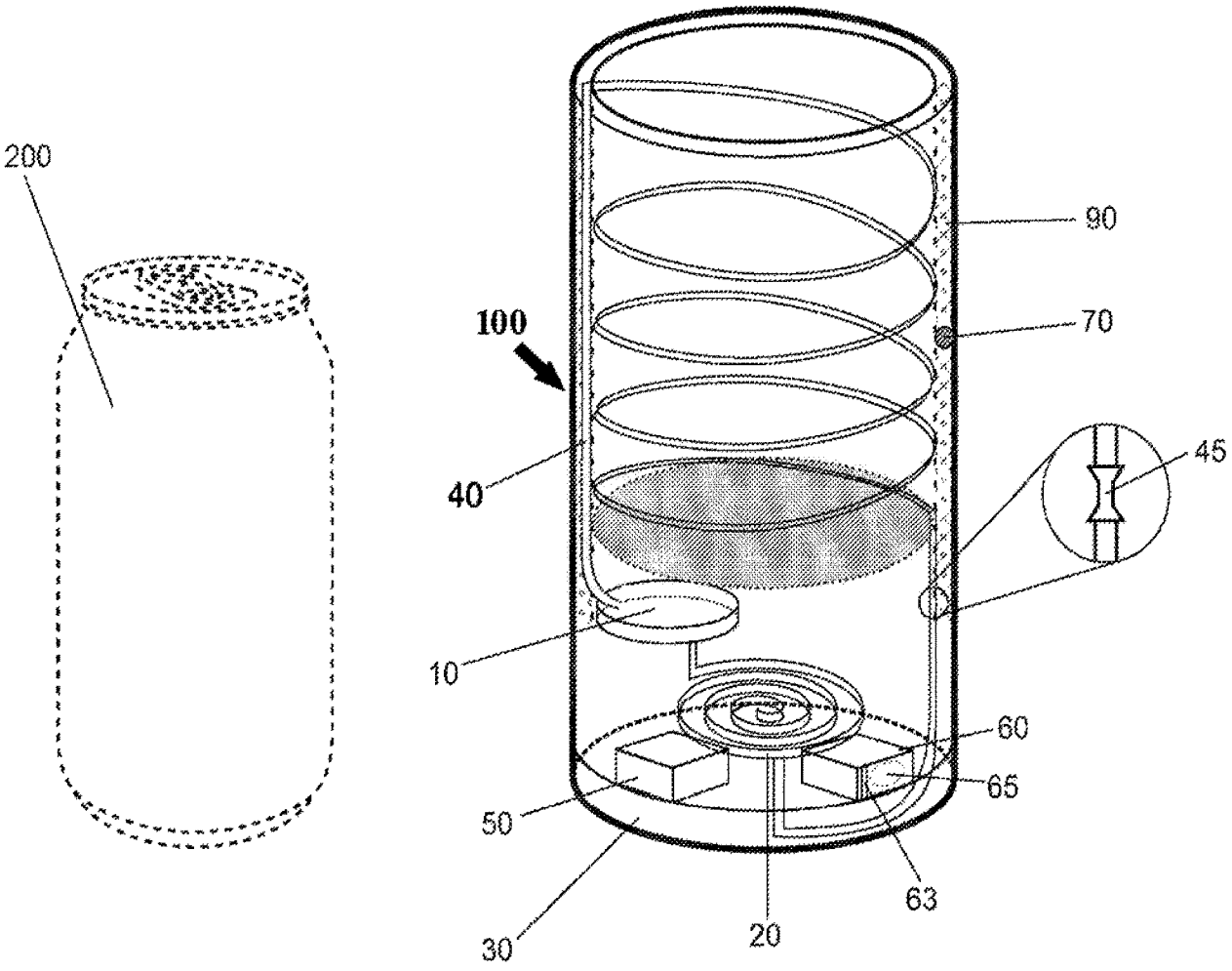
FIG. 2: is a second embodiment of a self-cooling device is in the form of a sleeve or similar holder in which a beverage container is put into to be cooled.
Figure 3:
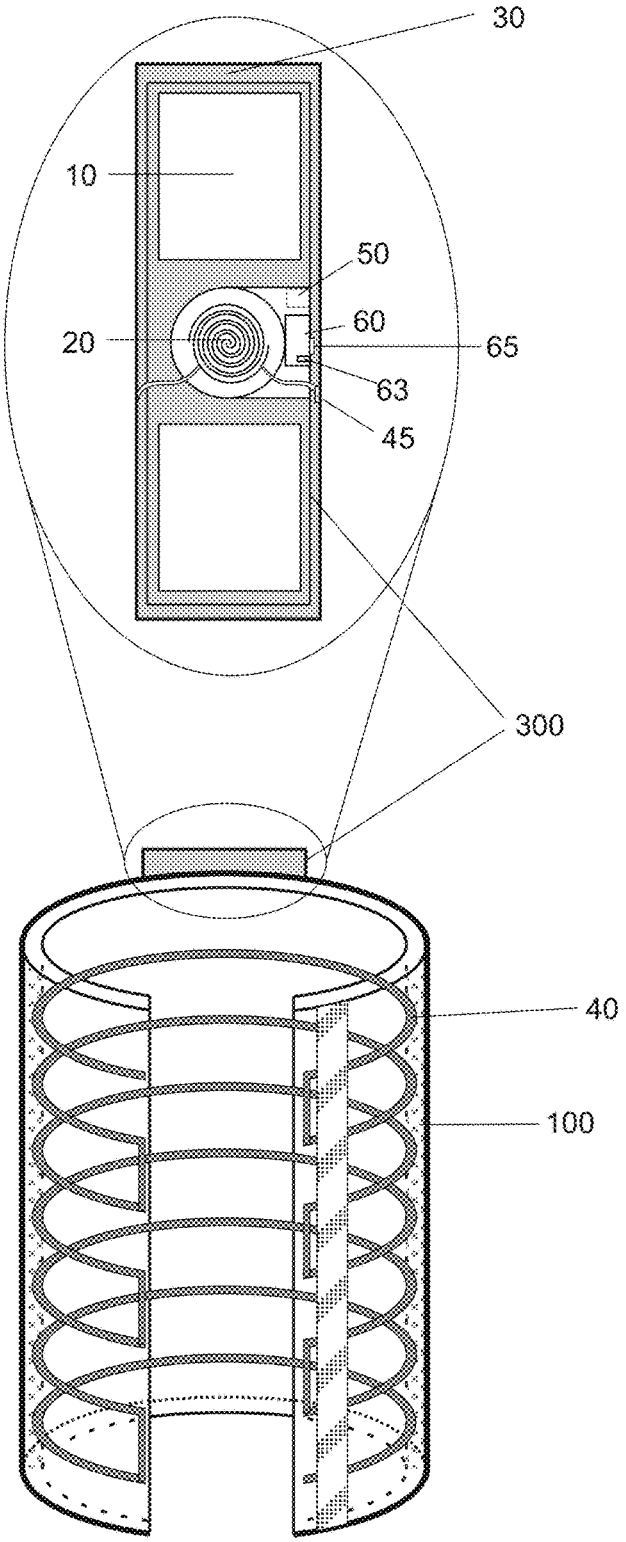
FIG. 3: is a third embodiment of a self-cooling device is in the form of a flexible holder which can be wrapped around a beverage container to be cooled.

The self-cooling device can be adapted in several embodiments:

- It could be used as in the form of a mug or bucket-like container to hold the beverage which is poured into it from another beverage container. An embodiment of this is illustrated in FIG. 1.
- It could be used in the form of a sleeve or jacket to enclose a beverage container. An embodiment of this is illustrated in FIG. 2.
- It could be in the form of two curved portions which can be wrapped around a beverage container. An embodiment of this is illustrated in FIG. 3.

Whatever form the self-cooling device can take, it consists of a miniaturized scroll compressor (20) of sufficient power and material strength to forcefully compress the refrigerant used, pumping the refrigerant from a reservoir (10) through a heat sink, then through an expansion valve into a network of capillaries (40), before it returns to the reservoir (10), wherein the refrigerant is stored. The miniaturised scroll compressor (20) is driven by an appropriately sized and efficient electric motor (50). The refrigerant is pumped by the miniaturised scroll compressor (20) through the network of capillaries (40) which is spread out over the entire surface area inside the walls of the container self-cooling devices. The network of capillaries (40) can take several patterns or designs instead of being circular as shown in the drawings. The network of capillaries (40) can also be configured into any design that does not impair the functionality of the capillaries.

The network of capillaries (40) is made of any appropriate material, e.g. fine copper tubing or glass, and can be in the form of circular rings or lattice embedded inside the walls of the container thus covering a wide surface area.

The self-cooling device has a power source (60) which supplies electrical power to the motor (50) powering the miniaturised scroll compressor (20) to enable it to pump the refrigerant through the network of capillaries (40). The network of capillaries (40) would offer a larger combined surface area to absorb heat from the contents of the self-cooling device. Upon returning to the reservoir, the refrigerant is once again pumped by the scroll compressor through itself and then through the heat sink, allowing the refrigerant to be cooled further before being forced through the expansion valve, where the refrigerant is cooled as it expands.

The heat sink will thus enable the refrigerant to be more efficient as it is cooled down before it carries out another heat exchange process as it goes through the network of capillaries.

The self-cooling device also has a micro-processor (not shown) to control the entire cooling operation. The cooling device also has one or more temperature gauging devices (70) in the interior wall (82) of the self-cooling device which envelopes the beverage container or holds the beverage container. The temperature readings of the contents of the self-cooling device are monitored by the micro-processor which, in turn, would continue to run the motor (50) connected to the miniaturised scroll compressor (20) to pump refrigerant through the heat sink, and then through the expansion valve (45) and into the network of capillaries (40) until the user defined temperature settings are obtained, set by a simple user interface for temperature setting, which is not shown.

The self-cooling also has an on/off switch (65) which can be manually operated to turn the miniaturised scroll compressor off or on as desired by the user.

The self-cooling device can be incorporated into several embodiments, all of which are proposed as self-cooling containers.

An embodiment can be a self-cooling device is in the form of a mug or jug which can then be used to contain a beverage which is poured from a beverage container, as illustrated in FIG. 1. In this embodiment, the miniaturised scroll compressor (20) can be at the base of container which may be a mug or jug. The network of capillaries (40) is formed inside the wall (80) of the mug or jug into which the beverage is contained. The wall (80) of the mug or jug can be made of material which protects the network of capillaries (40) and at the same time allows for efficient heat exchange from the beverage in the mug or jug to the refrigerant in the network of capillaries (40) within the interior wall of the mug or jug. Since the contents of the beverage are directly held within the mug or jug, the cooling efficiency of the self-cooling device is improved. As the beverage itself does not come into contact with the capillary network or the refrigerant, there is no concern over contamination by the refrigerant nor concern over chemical reaction between the refrigerant and the beverage itself.

In another embodiment, the self-cooling device can take the form of a cylindrical sleeve with a base, containing a miniaturised scroll compressor. This second embodiment is illustrated in FIG. 2. In this embodiment, the network of capillaries (40) is formed inside the interior wall (82) of the cylindrical sleeve into which a beverage container (can) 200 may be held. The sleeve (100) can be made of material which protects the network of capillaries (40) and at 10 the same time allows for efficient heat exchange from the beverage container (70) to the refrigerant through an expansion valve (45) and into the network of capillaries (40). Since the contents of the beverage are still in the beverage container (70), which is contained by the cylindrical sleeve (90), the cooling efficiency of the self-cooling device may be lower. Nonetheless, since the objective is to cool a beverage container in the outdoors, the self-cooling device of this embodiment would still work. As the beverage itself does not come into contact with the capillary network or the refrigerant, there is no concern over contamination by the refrigerant nor concern over chemical reaction between the refrigerant and the beverage itself.

In a third embodiment, the self-cooling device is in the form of a flexible sleeve adjustable to fit containers of different volumes and sizes. The third embodiment may be illustrated in FIG. 3. The flexible sleeve (100) is open ended so that it can be adjustable to hold a container of beverage of different sizes. The open ends have Velcro® or similar closures to wrap the beverage container (not shown) snuggly around it. In this embodiment, the miniaturized scroll compressor can be at the base of the sleeve, or attached to the middle of the flexible sleeve, or in a casing or box 300 completely (shown in FIG. 3) separated from the flexible sleeve (100) itself, whilst still connected to the 30 flexible holder through the necessary wires and tubes contained within a protective tubing for wires. The network of capillaries (40) is formed inside the wall of the flexible sleeve (100). The interior-wall material of the flexible sleeve can be made of material which protects the network of capillaries (40) and at the same time allows for efficient heat exchange from the beverage container (not shown) to the refrigerant in the network of capillaries (40) within the interior-wall of the flexible sleeve. As the beverage itself does not come into contact with the capillary network or the refrigerant, there is no concern over contamination by the refrigerant nor concern over chemical reaction between the refrigerant and the beverage itself. However, since the content of the beverage is not directly in contact with the cooling device, its cooling efficiency of the self-cooling device is not as efficient.

If the self-cooling device is in the form of a mug, the temperature gauging devices (70) can directly monitor the temperature of the contents of the beverage since the beverage is held within the mug as shown in FIG. 1. In this case, as the contents of the beverage is consumed, and the level of the beverage in the mug drops, the temperature sensors (70) at the upper level of the mug would pick up the surrounding higher ambient temperature and continue to send incorrect readings (incorrect readings for the purposes of this device's cooling functionality) to the micro-processor (not shown) which will continue to pump refrigerant in an effort to lower the temperature detected at that area. In order to maintain efficient energy usage, additional sensors may be installed in self-cooling devices in the mug to monitor level of beverage contained in the mug. Therefore even though the beverage is consumed and the level of beverage within the mug drops, the micro-processor is able to detect the boundary between cooled beverage and ambient air. As the boundary lowers from consumption, the micro-processor will be configured to expend the correct amount of energy to only cool the beverage rather than ambient air.

How the micro-processor determines the boundary between the cooled beverage and the ambient air is as follows: there will be one Control sensor which continuously records the ambient air's temperature. The remaining sensors will be vertically lined along the interior wall of the self-cooling container. As the beverage level decreases, the boundary between the cooled beverage and ambient air lowers, thus exposing some of the sensors lining the interior wall to ambient air. As the interior-wall vertically aligned sensors are exposed to ambient air, their temperature would match the Control sensor's reading, thus telling the micro-processor that the volume of the content has decreased. The micro-processor would be configured to know how much energy to expend from the number of vertical sensors matching the Control sensor.

Since the self-cooling device is meant for outdoor use, it would be powered by batteries. Alternatively the power source consists of a rechargeable battery which can be re-charged when the electrical energy level is low. For the recharging, the charging could be through a wire connected to any electric power source. Alternatively, configurations can be modified for indoor usage that could require the use of a wall socket power source.

While some embodiments of the self-cooling device have been described, it should be apparent, however, that various modifications, rearrangements, substitutions alterations and adaptations to those embodiments may occur to persons skilled in the art with the attainment of some or all of the advantages of the present invention. Accordingly, it should be clearly understood that the present invention is not intended to be limited by the particular features and structures hereinbefore described and depicted in the accompanying drawings. It is therefore intended to cover all such modifications, alterations and adaptations without departing from the scope and spirit of the present invention as defined by the appended claims.

ADVANTAGEOUS EFFECTS OF THE INVENTION

The invention offers a light, portable and practical device to cool beverages directly or indirectly in the outdoors.

What is claimed is:

1. A self-cooling container for cooling a beverage internally, comprising:

a body;

a handle bar attaching to the body;

a cooling device, comprising:

a miniaturised scroll compressor;

an electric motor, having an inlet for electric power;

a heat sink;

a microprocessor; and an expansion valve;

a network of capillaries, spirally embedded within a wall of the body and within said handle bar for cooling down both said body and said handle bar, and containing a refrigerant, wherein said network of capillaries passes through said handle bar and connects to a reservoir such that a closed loop of refrigerant is formed sequentially by the miniaturised scroll compressor, the heat sink, the expansion valve, the network of capillaries, and the reservoir;

a power source of electrical energy;

a plurality of temperature gauging devices, mounted in a wall of the body, wherein one of the plurality of temperature gauging devices is a control sensor detecting a temperature of ambient air, wherein the plurality of temperature gauging devices other than the control sensor are vertically aligned;

a temperature setting interface; and an on/off switch for connecting the power source to the electric motor for driving said miniaturised scroll compressor;

wherein the miniaturised scroll compressor performs a first heat exchange with the interior wall of the body and the handle bar by pumping the refrigerant from the reservoir through the network of capillaries;

wherein the miniaturised scroll compressor performs a second heat exchange with the heat sink by pumping the refrigerant from the reservoir through the heat sink, transferring the heat from the compressor to the heat sink before being pumped through the expansion valve; and wherein the microprocessor detects a boundary between the beverage and the ambient air by processing signals of the plurality of temperature gauging devices to signals of the control sensor, and controls the motor accordingly.

2. The self-cooling container as claimed in claim 1, wherein the plurality of temperature gauging devices is to detect beverage temperature of the container.

3. The self-cooling container as claimed in claim 1, wherein the body is a sleeve.

4. The self-cooling container as claimed in claim 1, wherein the body is bucket-shaped.

5. The self-cooling container as claimed in claim 2, wherein the plurality of temperature gauging devices sends temperature readings to the micro-processor for continuing to control the motor connected to the compressor.

6. The self-cooling container as claimed in claim 1, wherein the power source of electrical energy are batteries.

7. The self-cooling container as claimed in claim 1, wherein the power source of electrical energy is connected to the inlet.

8. The self-cooling container as claimed in claim 1, wherein the power source of electrical energy is an USB inlet.

9. The self-cooling device as claimed in claim 1, wherein the heat sink has a fan.

10. The self-cooling device as claimed in claim 1 is a mug.

11. The self-cooling device as claimed in claim 1, wherein the microprocessor determines the boundary between the beverage and the ambient air by comparing signals of the plurality of temperature gauging devices to signals of the control sensor.

12. The self-cooling device as claimed in claim 11, wherein the microprocessor monitors a level of the beverage contained in the device based upon the boundary and controls the motor according to the level and corresponding volume of the beverage.

13. A self-cooling mug, comprising:

a body;

a handle bar attaching to the body;

miniaturised scroll compressor;

an electric motor;

a heat sink located at a bottom of said body;

a microprocessor;

a reservoir;

an expansion valve;

a capillary, containing refrigerant and spirally embedded within a wall of said body and within said handle bar for cooling down both said body and said handle bar, wherein said capillaries passes through said handle bar and connects to a reservoir such that a closed loop of refrigerant is formed sequentially by the miniaturised scroll compressor, the heat sink, the expansion valve, the network of capillaries, and the reservoir;

a temperature setting interface;

a plurality of temperature gauging devices, mounted in a wall of the body, wherein one of the plurality of temperature gauging devices is a control sensor detecting a temperature of ambient air, wherein the plurality of temperature gauging devices other than the control sensor are vertically aligned; and an on/off switch for control of said electric motor for driving said miniaturised scroll compressor;

wherein the microprocessor detects a boundary between the beverage and the ambient air by processing signals of the plurality of temperature gauging devices to signals of the control sensor, and controls the motor accordingly.

14. The self-cooling device as claimed in claim 13, wherein the microprocessor determines the boundary between the beverage and the ambient air by comparing signals of the plurality of temperature gauging devices to signals of the control sensor.

15. The self-cooling mug as claimed in claim 14, wherein the microprocessor monitors a level of the beverage contained in the mug based upon the boundary and controls the motor according to the level and corresponding volume of the beverage.

* * * * *